US005347344A

United States Patent [19]

Itoh

[11] Patent Number: 5,347,344

[45] Date of Patent: Sep. 13, 1994

[54] METHOD FOR RECYCLING AN INK SHEET AND THERMAL TRANSFER PRINTER USING THE SAME

[75] Inventor: Shinichi Itoh, Tokyo, Japan

[73] Assignee: Oki Electric Industry Co., Ltd., Tokyo, Japan

[21] Appl. No.: 107,989

[22] Filed: Aug. 18, 1993

[30] Foreign Application Priority Data

Aug. 24, 1992 [JP] Japan ..... 4-223921

[51] Int. Cl.[5] ..... G03G 15/00; G03G 21/00

[52] U.S. Cl. ..... 355/200; 355/210; 346/76 PH; 400/197; 400/198; 400/200

[58] Field of Search ..... 355/200, 210, 211, 212, 355/213, 271, 273, 277, 282, 285, 289, 290, 295, 257; 346/76 PH, 76 R; 400/197, 198, 200; 250/316.1, 317.1, 318; 430/32, 348

[56] References Cited

U.S. PATENT DOCUMENTS

| | | | |
|---|---|---|---|
| 4,359,748 | 11/1982 | Pasini et al. | 346/76 PH |
| 4,976,986 | 12/1990 | Akutsu et al. | 427/27 |
| 5,057,875 | 10/1991 | Itoh | 355/277 X |
| 5,148,225 | 9/1992 | Takeda et al. | 355/210 X |
| 5,170,187 | 12/1992 | Oikawa | 346/76 PH |
| 5,196,870 | 3/1993 | Itoh et al. | 355/212 X |
| 5,198,835 | 3/1993 | Ando et al. | 346/76 PH |
| 5,237,368 | 8/1993 | Itoh et al. | 355/202 |

FOREIGN PATENT DOCUMENTS

| | | | |
|---|---|---|---|
| 0193863 | 8/1987 | Japan | 400/198 |
| 0239981 | 9/1990 | Japan . | |

OTHER PUBLICATIONS

Nose et al, "A Color Thermal Transfer Printer with Recording Mechanism", SID 85 Digest, pp. 143 to 145, 1985.

*IBM Technical Disclosure Bulletin,* vol. 32, No. 4A, "Improved Reflow Head Design", pp. 456–457, Sep. 1989.

*Primary Examiner*—Matthew S. Smith

*Attorney, Agent, or Firm*—Steven M. Rabin

[57] ABSTRACT

A thermal transfer printer capable of quickly starting after being turned on and reproducing high quality color images, includes a photosensitive roller forming a charge pattern according to an ink transferred portion on an ink sheet at a time that the photosensitive roller is exposed to light from a light source through ink transferred portion of the ink sheet while the ink sheet is superimposed on the photosensitive roller. Nonconductive, charged ink powder is applied only to the ink transferred portion by electrostatic force produced in correspondence with the charge pattern. The ink powder filled in the ink transferred portion is then fused by a heating roller to form a uniform thickness of the ink layer of the ink sheet, and the ink sheet is used again for the thermal head of the printer.

18 Claims, 3 Drawing Sheets

METHOD FOR RECYCLING AN INK SHEET AND THERMAL TRANSFER PRINTER USING THE SAME

BACKGROUND OF THE INVENTION

1. Field of the Invention

This invention relates to a method for recycling an ink sheet and a thermal transfer printer using the same.

2. Description of Related Art

Thermal transfer printers have been used widely, since those printers can be compact and inexpensive and readily obtain high printing quality. In a conventional thermal transfer printer, an ink sheet, as a recording material, is fed between a thermal head and a platen with a printing paper, and thermal elements of the thermal head are selectively driven to transfer the thermoplastic ink onto the printing paper in accordance with printing data sent to the thermal head. However, most of the ink coated on the ink sheet, except a portion transferred to the paper, is thrown away together with a polymer base film of the ink sheet. This leads to high running costs.

To solve such a problem, some recycling apparatuses for an ink sheet have been devised for restoring the portion transferred to the printing paper. A printer equipped with a recoating mechanism restores portions of an ink layer transferred onto the printing paper, as described in SID 85 Digest, pages 143 to 145, "A Color Thermal Transfer Printer with Recording Mechanism," by Nose et al. The recoating mechanism includes a heat-insulated ink tank, an ink roller with a built-in heater and spiral V-shaped grooves, and a rubber coated reverse roller. Thermoplastic ink in the ink tank is melt by the built-in heater in the ink roller. According to rotation of the ink roller, the ink is conveyed onto the reverse roller. thereby being coated by the reverse roller to an endless ink sheet, which is fed between the reverse roller and a back up plate. Then, the recoated ink sheet is used again for printing.

Another printer restores transferred portions of the ink sheet by using magnetic, conductive ink powder. The ink powder is applied by a brush to an ink sheet while a bias voltage is applied between the brush and a back up electrode disposed behind the ink sheet. The ink sheet is charged in proportion to a product of static capacitance of the ink sheet and the bias voltage and attracts the ink powder. However, the ink powder is not attracted to portions at which the ink is remaining, because the conductive ink serves as only a passage of charge and prevents the occurrence of static electric force. As a result, the ink powder is attracted only to portions at which the ink has been transferred, so that the ink layer of the ink sheet is restored to be almost single layer by using such conductive ink powder.

However, the printer with the recoating mechanism cannot print until the solid ink having a large heat capacity is adequately melt at the beginning of the printing. Moreover, in the case when the printer is to be moved, the ink may still be in a fluid state for a while even after power to the printer is off, so that the ink may be spilt in the printer.

In the case of the printer using the ink powder to restore the ink sheet as described above, the ink powder must be conductive, because the ink powder is applied by electrostatic induction only to portions at which the ink has already transferred and the base film is exposed. Accordingly, the ink powder must be mixed with conductive particles, so that such conductive particles reduces saturation of color when used for a color ink. As a result, when color printing is done with the printer using conductive powder, a range of color reproduction becomes narrow.

SUMMARY OF THE INVENTION

It is an object of the invention to provide a method for recycling an ink sheet and a thermal transfer printer using the same in which the printer can start quickly after being turned on and in which the printer can reproduce a wide range of colors readily.

The foregoing object is accomplished with a method for recycling an ink sheet in which ink powder is applied selectively to an ink transferred portion on an ink sheet corresponding to a charge pattern formed on a photosensitive roller by exposing the roller to light. That is, an ink sheet having an ink remaining portion and an ink transferred portion is first o superimposed on a photosensitive roller charged uniformly by a charging roller. The photosensitive roller is exposed to light through the ink sheet, so that the light is absorbed at the ink remaining portion and reaches the surface of the photosensitive roller at the ink transferred portion, thereby forming a charged pattern in accordance with the ink transferred portion. Charged ink powder is then applied only to the ink transferred portion by a electrostatic force occurring corresponding to the charged pattern and is fused to form a uniform thickness of the ink sheet. Since the charged ink powder is applied by electrostatic force, the ink powder can be nonconductive, so that it is unnecessary to mix conductive particles with the ink powder. The ink powder is fused only on the ink sheet after applied to the ink transferred portion. Therefore, the printer can quickly start printing after turned on.

In another aspect of the invention, a thermal transfer printer includes a photosensitive roller, charging means for uniformly charging the photosensitive roller, image forming means for forming image by selective heating an ink sheet and transferring an ink layer of the sheet to a printing medium according to printing data. The photosensitive roller is exposed to the light from exposing means through the ink sheet so that a charge pattern is formed only at an ink transferred portion of the ink sheet. Ink applying means applies ink powder to the ink transferred portion in accordance with electrostatic force occurring in correspondence to the charge pattern. The ink powder applied onto the ink sheet is then fused by fusing means to form a uniform thickness of the ink sheet suitable for the image forming means.

BRIEF DESCRIPTION OF THE DRAWINGS

The above and other objects and features of the invention are apparent to those skilled in the art from the following description of preferred embodiments thereof when considered in conjunction with the accompanied drawings, in which.

DETAILED DESCRIPTION OF THE PREFERRED EMBODIMENTS

Figure 1:
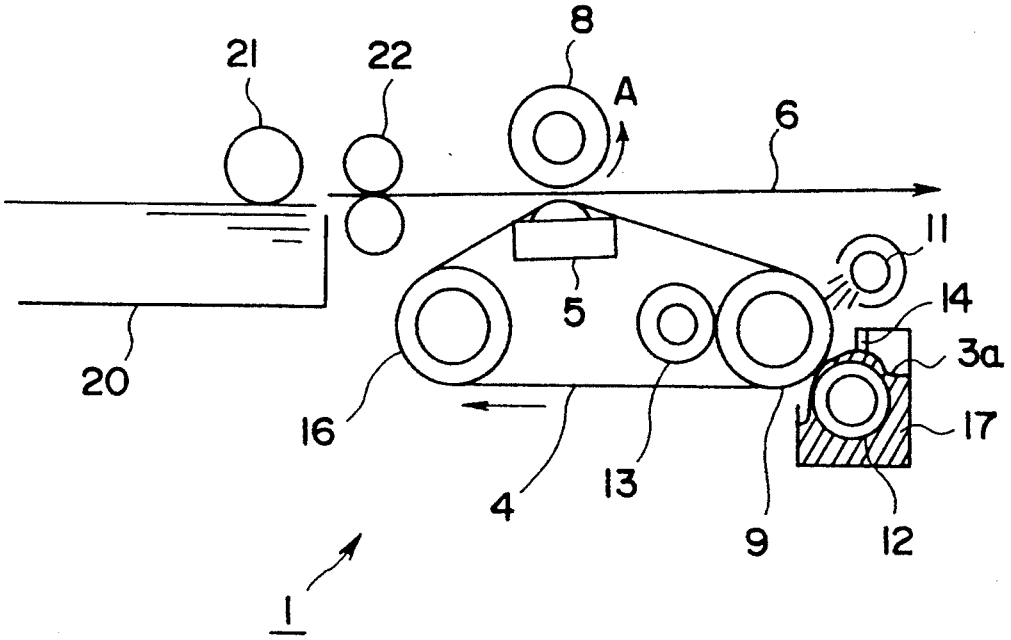
FIG. 1 is a diagram illustrating a thermal transfer printer using a method for recycling an ink sheet according to a preferred embodiment of the invention.

Referring to the drawings in detail, in particular, to FIG. 1, a thermal transfer printer according to a preferred embodiment of the invention is shown. The thermal transfer printer, generally designated by the numeral 1, uses a method for recycling an ink sheet 4. The thermal transfer printer 1 has a thermal head 5 as image forming means for selectively heating an ink layer 3 (FIG. 2) of the ink sheet 4 and transferring the ink layer 3 onto a printing medium 6 such as plain paper when the thermal head 5 receives printing data in a manner known to those skilled in the art. The thermal head 5 is disposed so as to oppose to a platen roller 8. The ink sheet 4, as well as the printing medium 6, is sandwiched between the thermal head 5 and the platen roller 8 and is clamped with a constant pressure.

Figure 2:
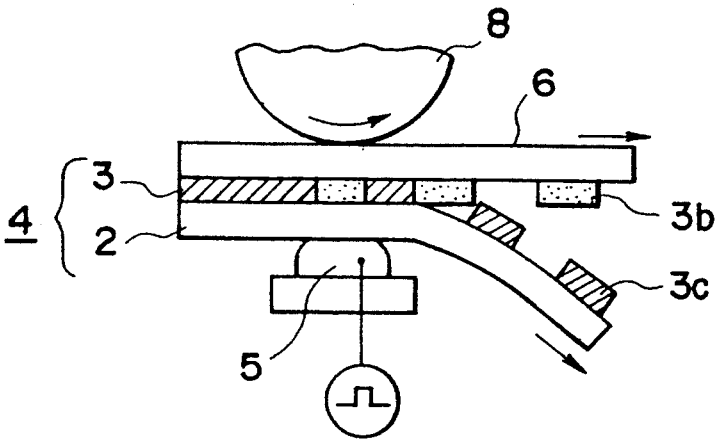
FIG. 2 is a diagram illustrating an image forming process of the method.

The ink sheet 4 is an endless sheet as a recording material and is composed of a transparent polymer base film 2 and the ink layer 3 coated on the base film 2. The ink sheet 4 passing over the thermal head 5 includes an ink transferred portion 3*d* (See FIG. 5), corresponding to an ink layer portion 3*b* at which the ink layer 3 is transferred to the printing medium 6 during passing between the thermal head 5 and the platen roller 8 and an ink remaining portion 3*c* at which the ink layer 3 is remaining on a base film 2, as shown in FIG. 2. The base film 2 can be coated with a sliding layer on a back surface thereof, contacting with the thermal head 5 for improved sliding of the base film 2 when necessary. Films, such as polyester, polyimide, polyether imide, polyether sulfone, polyether ethyl ketone, and the like, can be used for the base film 2. The thickness of the base film 2 is preferably equal to or greater than 3 microns for the sake of strength and handling and is preferably equal to or less than 30 microns for the sake in of heat transfer during the image forming process. The ink layer 3 has a property for absorbing light from a light source 11 as described below. The ink layer 3 may include wax, resin mixed with pigments and dyes and the like.

The numeral 9 indicates a photosensitive roller as photosensitive means provided on a downstream side of and next to the thermal head 5. The photosensitive roller 9 has a core material 9*a*, for example such as aluminum, and a chargeable photosensitive surface at the circumference of the roller, formed by a polymer photosensitive layer 9*b* that coats a circumferential surface of the core material 9*a*. The photosensitive roller 9 is rotatable around its axis with the same speed to the ink sheet 4, so that the ink sheet 4 is fed around the photosensitive roller 9 in non-sliding contact therewith. A charging roller 13 contacts the photosensitive roller 9 at a point where the ink sheet 4 is not wound on or in contact with the photosensitive roller 9. The charging roller 13 has a core metal and a conductive rubber face. The charging roller 13 continuously provides electric charges uniformly to the surface of the photosensitive roller 9 according to a bias voltage applied between the core metal thereof and the core material 9*a* of the photosensitive roller 9. In lieu of the charging roller 13 as shown in FIG. 1, a corona discharger can be used as charging means.

The light source I 1 is disposed at a point that the ink sheet 4 having the ink transferred portion is superimposed on the photosensitive roller 9. The light source 11 emits light toward the photosensitive roller 9 through the ink sheet 4 to form a charge pattern on the surface of the photosensitive roller 9. When light from the light source 11 reaches the surface of the photosensitive roller 9, the electric charges provided by the charging roller 13 are canceled by charges having an opposite polarity generated by the light. Where the ink remaining portion 3*c* is on the ink sheet 4, the light is blocked and never reaches the photosensitive roller 9.

Below the light source 11, an ink conveying roller 12 is provided for applying ink powder 3*a* stored in a container 17. The ink conveying roller 12 contacts or is provided adjacently to the ink sheet 4 closely contacting the photosensitive roller 9. The ink conveying roller 12 attracts the ink powder 3*a* by electrostatic force and makes the thickness of the ink powder 3*a* on the roller 12 uniform with a blade 14 as thickness uniform means. The ink powder 3*a* of the uniform thickness is applied to the ink sheet 4 and adheres only to the ink transferred portion 3*d* as described below.

The numeral 16 is a heating roller as heating means for fusing the ink powder 3*a* on the ink sheet 4. The heating roller 16 is made of a metal material and has a hollow with a built-in halogen lamp. A heating member formed with a heating resistance layer, such as Ni-P, formed on a surface of a base, such as glass, ceramic, or the like, and coated with a protection layer, such as fluororesin and the like, thereon can be used in lieu of the heating roller 16. The heating roller 16 heats the ink powder 3*a* on the ink sheet 4 while the ink sheet 4 goes around the heating roller 16, thereby fusing the ink powder 3*a* so as to be uniform with the ink remaining portion 3*c*. The ink sheet 4, having the ink layer 3 of uniform thickness with the fused ink powder 3*a*, is then fed as the recycled ink sheet to the thermal head 5.

The thermal transfer printer I thus constructed also includes a printing media feeding mechanism as well as an ordinary printer. Namely, a paper cassette 20 is provided for storing printing media 6 such as plain paper, and the printing medium 6 is fed by a feeding roller 21 and a pair of transfer rollers 22 toward a space between the thermal head 5 and the platen roller 8.

Since the ink sheet 4 is endless, the route of the ink sheet 4 starts from and returns to the thermal head 5 through the photosensitive roller 9, which is surrounded by the light source 11, the ink conveying roller 12, and the charging roller 13, and the heating roller 16. During a rotation of the ink sheet 4, a method for recycling an ink sheet is performed according to the following steps.

When the thermal transfer printer 1 is turned on, the halogen lamp of the heating roller 16 is then energized. Since a thermometer not shown is disposed in the heating roller 16, the heating roller 16 is controlled based on the temperature detected by the thermometer and is kept at a temperature for suitable to fuse the ink powder 3*a*.

In image forming process, the platen roller 8 is rotated in a direction of arrow A by a driver not shown. A sheet of the printing medium 6 is fed from the paper cassette 20 by the feeding roller 21 through the pair of the transfer rollers 22 and reaches between the thermal head 5 and the platen roller 8. The printing medium 6 and the ink sheet 4 are then fed in the rotating direction of the platen roller 8. When the thermal head 5 receives an image signal, respective heat elements are selectively supplied with a voltage suitable to be heated in response to the image signal, and currents flow through the respective heat elements to heat the ink sheet 4 selectively. A portion of the ink layer 3 receiving heat through the base film 2 (the heated ink) is transferred onto the printing medium 6 and becomes an ink transferred portion 3*d*, whereas a portion of the ink layer 3 not receiving heat remains on the base film 2 and becomes an ink remaining portion 3*c*, as shown in FIG. 2.

Figure 3:
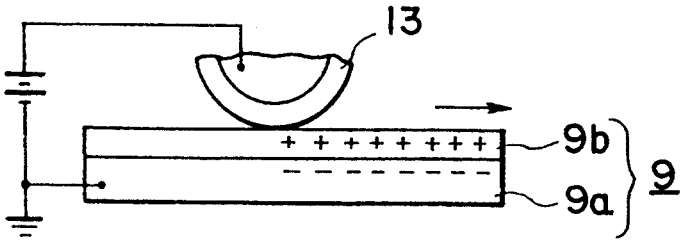
FIG. 3 is a diagram illustrating a charging process of the method.

Meanwhile, each of the following processes proceeds at the same time as the image forming process. In the charging process, the photosensitive roller 9, rotating together with feeding of the ink sheet 4, is uniformly charged by the charging roller 13. In order to charge the photosensitive roller 9 uniformly as shown in FIG. 3, a bias voltage is applied between the core metal of the charging roller 13 and the core material 9*a* of the photosensitive roller 9. The charge potential of the surface of the photosensitive roller 9 is controlled by the bias voltage.

Figure 4:
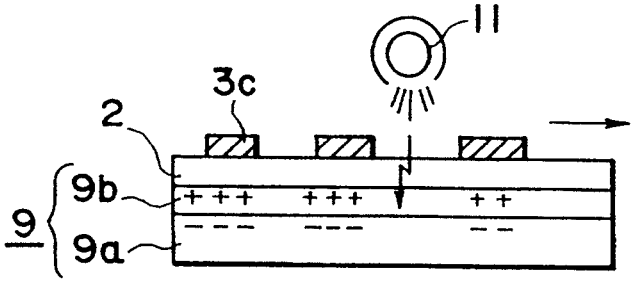
FIG. 4 is a diagram illustrating a light exposing process of the method.

The charged surface of the photosensitive roller 9 then reaches a portion for light exposure. Since the light source 11 is disposed at a position at which the ink sheet 4 is contacted with and superimposed on the photosensitive roller 9, the photosensitive roller 9 is exposed to light emitted from the light source 1 I through the ink sheet 4 as shown in FIG. 4. As the ink layer 3 has a property of absorbing light, the photosensitive roller 9 is not exposed to the light at the ink remaining portion 3*c*. To the contrary, light is not absorbed at the ink transferred portion 3*d*, and accordingly reaches the photosensitive layer 9*b* of the photosensitive roller 9 through the ink sheet 4, and cancels the charges on the surface of the photosensitive layer 9*b*. Accordingly, a charge pattern corresponding to the pattern made of the ink transferred portion 3*d* and the ink remaining portion 3*c* is formed on the surface of the photosensitive roller 9.

Figure 5:
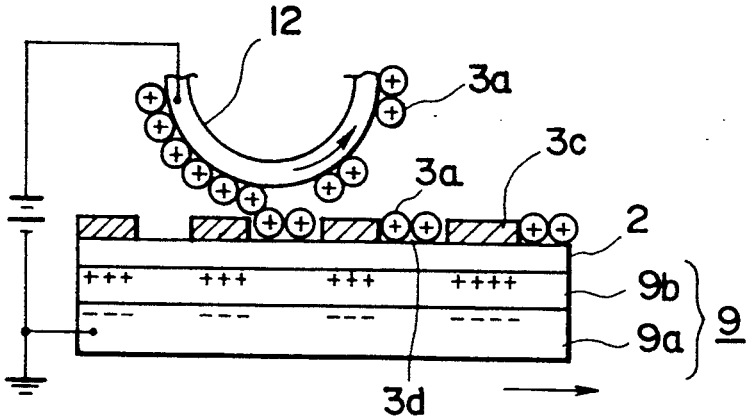
FIG. 5 is a diagram illustrating an ink powder coating process of the method.

As shown in FIG. 5, the ink conveying roller 12 applies ink powder 3*a* to the ink transferred portion 3*d* on the base film 2. At that time, an ink coating bias voltage is applied between the core material 9*a* of the photosensitive roller 9 and the ink conveying roller 12. Therefore, an electric field is produced through the insulating base film 2 between the photosensitive roller 9 and the ink conveying roller 12 in accordance with the charge pattern formed on the photosensitive roller 9. Since no charge exists at the ink transferred portion 3*d*, the charged ink powder 3*a* on the surface of the ink conveying roller 12 adheres to the ink transferred portion 3*d* according to the electrostatic force of the electric field. At the ink remaining portion 3*c*, electric charges in the photosensitive layer 9*b* prevents the ink powder charged with the same polarity from adhering to the surface of the ink sheet 4 by electrostatic force. Consequently, the ink powder 3*a* adheres only to the ink transferred portion 3*d* so as to replenish the partially removed ink layer 3. An amount of the ink powder 3*a*, or thickness of the ink layer 3, can be controlled by controlling the ink coating bias voltage. At the end of this ink applying process, a layer mixed with the ink powder 3*a* and the remaining ink is formed on the base film 2.

Figure 6:
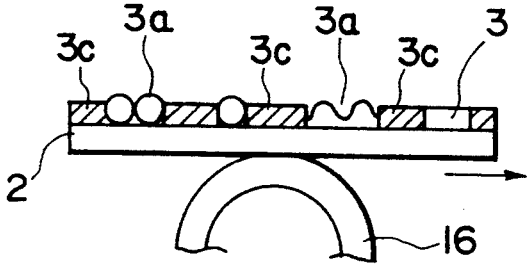
FIG. 6 is a diagram illustrating a fusing process of the method.

During a fusing process, as shown in FIG. 6, the ink powder 3*a* is heated and fused when the corresponding portion of the base film 2 passes on the heating roller 16. The fused ink powder 3*a* and the ink remaining portion 3*c* are combined at the border therebetween so as to eliminate the border and thereby reproduce a uniform ink layer 3 on the base film 2. The ink sheet 4 thus renewed is then fed to the thermal head 5 again to use as recording material.

In this embodiment, since the thermal transfer printer 1 generates an electric field and applies ink powder 3*a* by an electrostatic force without using electrostatic induction, it is unnecessary to mix conductive particles with the ink powder. Saturation of color is therefore not reduced, so that the thermal transfer printer can print with fine colors. The portion at which the ink is fused is only at the heating roller 16, so that the ink never spills in the printer and that the printer can start quickly after being turned on.

It is to be noted that although the heat-fusing type thermal transfer printer is described in the embodiment above, the invention may occur to any printer such as an electrical transfer type printer. Moreover, although the ink sheet 4 is described as endless, an ink sheet can be a roll type and be fed from a feeding reel to a take-up reel.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. A method for recycling an ink sheet composed of a transparent base film and an ink layer coated on said base film, said method comprising the steps of:

(a) superimposing said ink sheet, composed of an ink remaining portion at which said ink layer is remained on said base film and of an ink transferred portion at which said ink layer is removed from said base film, on a uniformly charged photosensitive means;

(b) exposing said photosensitive means to light through said ink sheet to form a charged pattern on a surface of said photosensitive means in accordance with said ink transferred portion;

(c) applying ink powder selectively to said ink transferred portion by electrostatic force occurring corresponding to said charged pattern; and (d) fusing said ink powder applied on said ink sheet to form a uniform ink layer with said ink remaining portion on said base film.

2. A thermal transfer printer for printing on a printing medium with ink transferred from an ink sheet having a transparent base film and an ink layer coated on the base film and for replenishing the transferred ink onto the base film, the printer comprising:

a. means for forming an image on the printing medium by selectively heating the ink layer and transferring heated ink onto the printing medium, thereby leaving the base film with a remaining ink layer coated on the base film so that the base film includes an ink remaining portion on which the remaining ink layer remains and an ink transferred portion on which the remaining ink layer is absent;

b. photosensitive means having an electrically chargeable photosensitive surface;

c. means for uniformly charging the photosensitive surface;

d. means for exposing the photosensitive surface to light through the ink transferred portion of the ink sheet with the ink sheet superimposed on the uniformly charged photosensitive surface, thereby to form a charge pattern on the photosensitive surface corresponding to the ink transferred portion;

e. means for applying charged ink powder selectively to the ink transferred portion with an electrostatic force provided by the charge pattern; and f. means for fusing the ink powder applied to the ink transferred portion to form with the remaining ink layer a uniform ink layer on the base film.

3. A thermal transfer printer as set forth in claim 2, wherein said photosensitive means is a photosensitive roller having said chargeable photosensitive surface on a circumference thereof for contacting said base film of said ink sheet, said photosensitive roller rotating together with said ink sheet.

4. A thermal transfer printer as set forth in claim 3, wherein said ink powder applying means is an ink conveying roller disposed adjacently to said photosensitive roller so as to produce said electrostatic force between said photosensitive roller and the ink conveying roller.

5. A thermal transfer printer as set forth in claim 2, wherein said fusing means is a h eating roller whose circumferential surface contacts said ink sheet.

6. A thermal transfer printer as set forth in claim 5, wherein said heating roller is equipped with a built-in heating lamp arranged therein.

7. A thermal transfer printer as set forth in claim 2, wherein said charging means is a roller constantly contacting said photosensitive means.

8. A thermal transfer printer as set forth in claim 2, wherein said image forming means is a thermal head driven in accordance with printing data.

9. A thermal transfer printer as set forth in claim 2, further comprising means for superimposing the ink sheet on the uniformly charged photosensitive surface.

10. A method for recycling an ink sheet, said method comprising the steps of:

(a) providing a previously used ink sheet composed of a transparent base film and a remaining ink layer coated on the base film, the transparent base film including an ink remaining portion on which the remaining ink layer remains and an ink transferred portion on which the remaining ink layer is absent;

(b) superimposing the ink sheet on a uniformly charged photosensitive surface;

(c) exposing the photosensitive surface to light through the ink transferred portion of the ink sheet to form a charge pattern on the photosensitive surface corresponding to the ink transferred portion;

(d) applying charged ink powder selectively to the ink transferred portion with an electrostatic force provided by the charge pattern; and (e) fusing the ink powder applied to the ink transferred portion during said step (d) to form with the remaining ink layer a uniform ink layer on the base film.

11. A method for recycling an ink sheet as set forth in claim 10, further comprising the step of forming an image on a printing medium by feeding said ink sheet with the uniform ink layer between said printing medium and a thermal head, and driving the thermal head according to printing data of said image.

12. A method for recycling an ink sheet as set forth in claim 10, wherein said ink powder is applied to the ink transferred portion from an ink conveying means disposed adjacently to said photosensitive surface.

13. A method for recycling an ink sheet as set forth in claim 12, wherein said electrostatic force is produced by supplying a voltage between a photosensitive means having said photosensitive surface and said ink conveying means.

14. A method for recycling an ink sheet as set forth in claim 13, further comprising the step of controlling the voltage to change thickness of said ink layer.

15. A method for recycling an ink sheet as set forth in claim 10, wherein said ink sheet is an endless sheet.

16. A method for recycling an ink sheet as set forth in claim 10, wherein said ink sheet is a roll type sheet.

17. A method for recycling an ink sheet as set forth in claim 10, wherein said base film has thickness equal to or greater than 3 microns and equal to or less than 30 microns.

18. A method for recycling an ink sheet as set forth in claim 10, wherein said step (b) includes providing a uniform positive charge on the photosensitive surface and said step (c) includes selectively neutralizing with the light only the positive charge on portions of the photosensitive surface on which the ink transferred portion of the ink sheet is superimposed.

* * * * *